US006634496B2

(12) United States Patent
Scoglio

(10) Patent No.: US 6,634,496 B2
(45) Date of Patent: Oct. 21, 2003

(54) UNIVERSAL GOLF CLUB CARRIER

(76) Inventor: Salvatore Scoglio, 117 Woodside Ave., Metuchen, NJ (US) 08840

( * ) Notice: Subject to any disclaimer, the term of this patent is extended or adjusted under 35 U.S.C. 154(b) by 0 days.

(21) Appl. No.: 10/163,952

(22) Filed: Jun. 7, 2002

(65) Prior Publication Data

US 2003/0034261 A1 Feb. 20, 2003

Related U.S. Application Data

(60) Provisional application No. 60/313,166, filed on Aug. 17, 2001.

(51) Int. Cl.[7] ..... A63B 55/08; A45C 5/14

(52) U.S. Cl. ..... 206/315.3; 206/315.4; 206/315.5; 206/315.6; 190/18 A; 280/DIG. 6

(58) Field of Search ..... 206/315.3, 315.6, 206/315.4, 315.5; 220/DIG. 6; 190/18 A

(56) References Cited

U.S. PATENT DOCUMENTS

| | | | | | |
|---|---|---|---|---|---|
| 2,629,609 | A | * | 2/1953 | Wilson | 206/315.3 X |
| 2,868,559 | A | * | 1/1959 | Vincelette | 280/DIG. 6 X |
| 3,334,910 | A | * | 8/1967 | Wilson et al. | 280/DIG. 6 X |
| 3,953,045 | A | * | 4/1976 | Feret, Jr. | 206/315.3 X |
| D272,285 | S | * | 1/1984 | Gillett | 280/DIG. 6 X |
| 4,726,597 | A | * | 2/1988 | Hickin | 280/DIG. 6 X |
| 4,792,152 | A | * | 12/1988 | Carolan | 280/DIG. 6 X |
| 4,860,889 | A | * | 8/1989 | Lemieux et al. | 206/315.6 |
| 4,890,856 | A | * | 1/1990 | Mursch et al. | 280/DIG. 6 X |
| 4,911,465 | A | * | 3/1990 | Hauer | 206/315.6 X |
| 5,112,068 | A | * | 5/1992 | Liao et al. | 206/315.3 X |
| 5,490,594 | A | * | 2/1996 | Rupe | 206/315.4 |
| 5,860,519 | A | * | 1/1999 | Meyer et al. | 206/315.3 |
| 6,056,301 | A | * | 5/2000 | Berliner et al. | 280/DIG. 6 X |
| 6,068,271 | A | * | 5/2000 | Lustica | 280/DIG. 6 X |
| 6,161,692 | A | * | 12/2000 | Lizarraga | 206/315.3 |
| 6,164,425 | A | * | 12/2000 | Latshaw | 206/315.3 X |
| 6,330,944 | B1 | * | 12/2001 | DeMichele | 206/315.3 |
| 6,460,867 | B2 | * | 10/2002 | Sciulli | 280/DIG. 6 X |

* cited by examiner

*Primary Examiner*—Sue A. Weaver
(74) *Attorney, Agent, or Firm*—Ezra Sutton

(57) ABSTRACT

The present invention provides a golf club carrier with a vertically extending golf club compartment for transporting golf clubs. The club carrier is integrally connected at its base to a wheel assembly. In addition, a retractable handle is connected to one side of the golf compartment which slides vertically relative to the golf club compartment. One or more collapsible compartments are provided on the side of the carrier. Also, a cover is provided which can be placed on the top of the carrier in order to cover the club heads.

7 Claims, 2 Drawing Sheets

UNIVERSAL GOLF CLUB CARRIER

This application claim the benefit under 35 U.S.C 119(e) of copending provisional application Serial No. 60/313,166 filed Aug. 17, 2001.

FIELD OF INVENTION

The present invention relates to a golf club carrier with wheels and an extendable handle which can be used as a golf club bag and as luggage when traveling. The carrier also provides additional integral compartments for transporting items such as golf balls, tees, and other items used on or off a golf course.

BACKGROUND OF THE INVENTION

Transporting golfing equipment from one location to another can be difficult. Normally, golf clubs are stored in the trunks of automobiles; however, when traveling by plane to distant locations, transporting golf clubs can be cumbersome and expensive. Moreover, in order to transport golf clubs by plane, it becomes necessary to place the golf club bag in a travel bag and check it with a person's checked in luggage. An alternative to transporting golf clubs would be to rent golf clubs and related equipment at a golf course; however, this can be just as expensive as checking in a golf club bag to be flown to a desired destination. Thus, there is a need for an efficient, compact and ergonomic golf club carrier which can carry golf clubs as well as related equipment.

It is an object of the present invention to provide an innovative alternative to conventional methods of transporting golf equipment in the form of a portable carrier with wheels and an extendable handle.

It is a further object of the present invention to provide a golf club carrier which can carry clubs, balls, tees and other items used on or off a golf course.

It is a further object of the present invention to provide an efficient, compact and ergonomic golf club carrier which can be transported either as a golf club bag or as luggage when traveling.

DISCUSSION OF PRIOR ART

Golf club carriers with wheels are known in the prior art such as U.S. Pat. Nos. 4,522,299; 6,161,698; 4,629,202; 6,161,692; 3,953,045; and 6,217,042. However, none of these patents disclose the specific combination of features of the present invention.

SUMMARY OF INVENTION

The present invention provides a golf club carrier with a vertically extending golf club compartment for transporting golf clubs. The club carrier is integrally connected at its base to a wheel assembly. In addition, a retractable handle is connected to one side of the golf compartment which slides vertically relative to the golf club compartment. Furthermore, one or more collapsible compartments are provided on the side of the carrier. Finally, a cover is provided which can be placed on the top of the carrier in order to cover the club heads.

DETAILED DESCRIPTION OF THE PREFERRED EMBODIMENT

Figure 1:
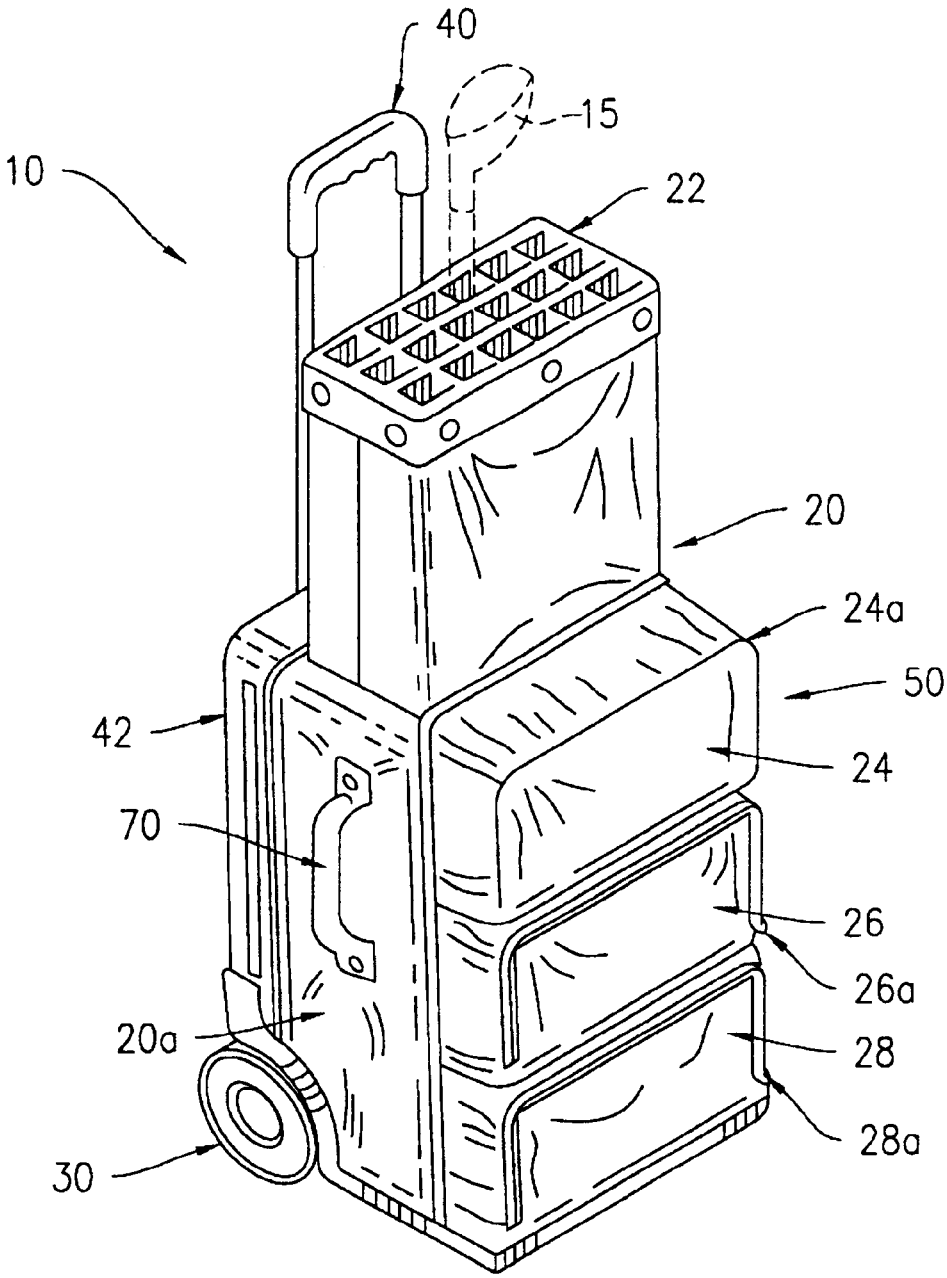
FIG. 1 is a perspective view of the front of a universal golf club carrier.
Figure 2:
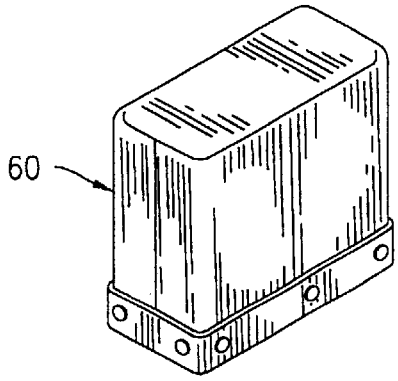
FIG. 2 is a perspective view of the cover of a universal golf club carrier.
Figure 3:
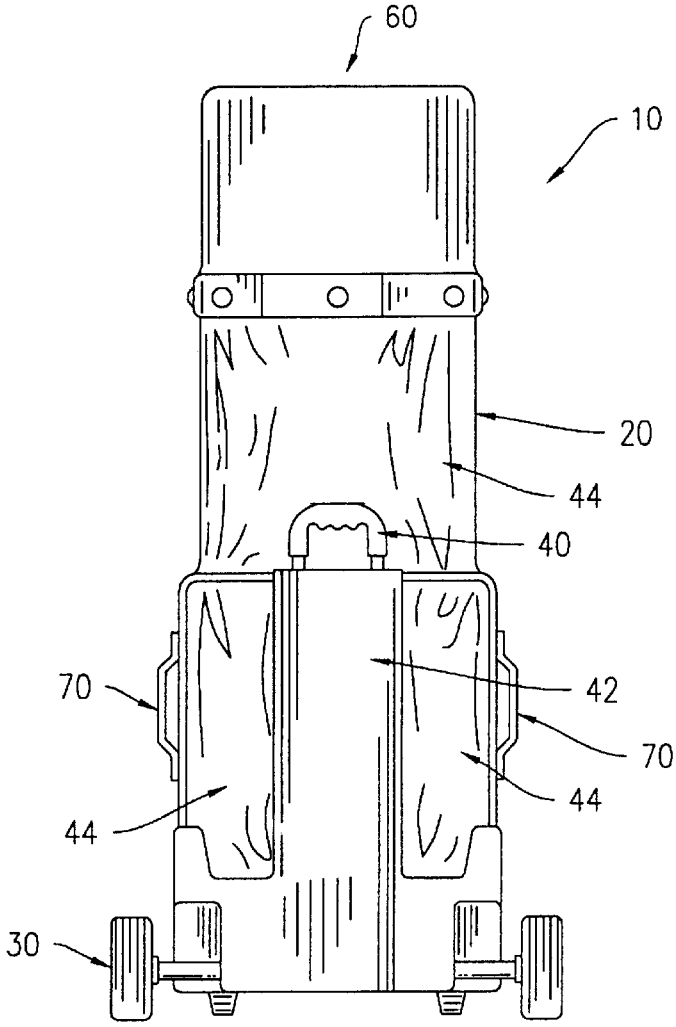
FIG. 3 is a perspective view of the back of a universal golf club carrier.

FIGS. 1 to 3 show a universal golf club carrier 10 comprising a vertically extending golf club compartment 20 for transporting golf clubs 15. A wheel assembly 30 is integrally connected to the base of the compartment 20 which is enclosed by soft material. In addition, a retractable handle 40 is connected to the rigid back section 42 of the golf club compartment 20 which slides vertically relative to the golf club compartment 20. The back section 42 also includes soft fabric sections 44. One or more collapsible compartments 50 are integrally attached to one side of the golf club compartment 20. In order to protect the heads of the clubs, a rigid cover 60 is placed over the golf club compartment 20.

The golf club compartment 20 may include a plurality of rigid and vertically extending storage channels 22 each for receiving a golf club 15. In order to carry golf related equipment, three (3) collapsible compartments 24, 26, 28 may be attached to golf club compartment 20. Compartments 24, 26, 28 are made of soft material and each contain a zipper 24*a*, 26*a*, 28*a* respectively for opening and closing the compartments 24, 26, 28. In addition, a handle 70 is mounted on the side 20*a* of golf club compartment 20. In order to store and transport additional golf clubs, up to eighteen (18) vertically extendable storage channels 22 can be provided. Finally, the wheel assembly 30 can be extended outwardly to provide greater stability when wheeling the carrier 10.

ADVANTAGES OF THE PRESENT INVENTION

It is an advantage of the present invention to provide and innovative alternative to conventional methods of transporting golf equipment in the form of a portable carrier with wheels and an extendable handle.

It is a further advantage of the present invention to provide a golf club carrier which can carry clubs, balls, tees and other items used on or off a golf course.

It is a further advantage of the present invention to provide an efficient, compact and ergonomic golf club carrier which can be transported either as a golf club bag or as luggage when traveling.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A universal gold club carrier being convertible to a luggage bag, comprising:

a) a vertically extending golf club compartment for transporting golf clubs;

b) a wheel assembly connected to the base of said golf club compartment;

c) a retractable handle connected to one side of said golf club compartment, which slides vertically relative to said golf club compartment; said retractable handle to be used as a luggage handle or as a handle to move said golf club carrier;

d) one or more collapsible compartments are disposed on one side of said golf club compartment;

e) said golf club compartment includes a plurality of vertically extending storage channels for receiving golf clubs; and f) a removable cover for the top of said golf club compartment.

2. A universal golf club carrier in accordance with claim 1, wherein said golf club compartment further includes three (3) of said collapsible compartments stacked in a vertical arrangement.

3. A universal golf club carrier in accordance with claim 1, wherein said golf club compartment further includes at least one lifting handle mounted on the side of said golf club compartment.

4. A universal golf club carrier in accordance with claim 1, wherein said golf club compartment further includes eighteen (18) vertically extending storage channels for receiving golf clubs.

5. A universal golf club carrier in accordance with claim 1, wherein said wheel assembly may be extended outwardly to provide greater stability when wheeling said carrier.

6. A universal golf club carrier in accordance with claim 1, wherein said removable cover includes closure means for attaching said removable cover to a proximal end of said vertically extending golf club compartment.

7. A universal golf club carrier in accordance with claim 6, wherein said closure means include male and female snaps for attaching said removable cover to said proximal end of said vertically extending golf club compartment.

* * * * *